US005634263A

United States Patent [19]

Leupold

[11] Patent Number: 5,634,263

[45] Date of Patent: Jun. 3, 1997

[54] METHODS OF MANUFACTURE OF PERMANENT MAGNET STRUCTURES WITH SHEET MATERIAL

[75] Inventor: Herbert A. Leupold, Eatontown, N.J.

[73] Assignee: The United States of America as represented by the Secretary of the Army, Washington, D.C.

[21] Appl. No.: 526,341

[22] Filed: Sep. 11, 1995

[51] Int. Cl.[6] ..... H01F 41/02

[52] U.S. Cl. ..... 29/607; 29/415; 29/416

[58] Field of Search ..... 29/607, 609, 602.1, 29/415, 416; 335/306

[56] References Cited

U.S. PATENT DOCUMENTS 2,433,660 12/1947 Granfield ..... 29/609 X
5,337,472 8/1994 Leupold et al. ..... 29/607

FOREIGN PATENT DOCUMENTS 9414175 6/1994 WIPO ..... 29/609

*Primary Examiner*—Carl E. Hall
*Attorney, Agent, or Firm*—Michael Zelenka; William H. Anderson

[57] ABSTRACT

Methods of manufacturing relatively complex permanent magnet structures utilizing sheets of permanent magnet material. Different permanent magnet structures such as rings, cylinders, spheres, oblate and prolate forms are made from cut or stamped sections of the sheets of permanent magnet material. In one embodiment, toroidal sections having a uniform magnetic orientation are cut or stamped out. The sections are rearranged to form a "magic" ring having a desirable substantially uniform magnetic field in the center thereof. In another embodiment, the "magic" rings are stacked together to form a "magic" cylinder. In another embodiment, the "magic" rings are divided and beveled to form wedges, slices, or spheroidal segments that are used to assemble a "magic" sphere having a central working cavity with a desirable relatively strong uniform magnetic field. In yet another embodiment, sheets of permanent magnet material are cut into trapezoidal sections and the trapezoidal sections arranged to form oblate and prolate permanent magnet structures that permit relatively distortion free polar and equatorial access respectively. The present invention, in utilizing a sheet of permanent magnet material and the stamping of shapes, makes possible inexpensive and easily mass produced manufacturing of relatively complex permanent magnet structures. This makes possible wide spread application of relatively complex permanent magnet structures having desirable magnetic fields to many known devices.

4 Claims, 6 Drawing Sheets

METHODS OF MANUFACTURE OF PERMANENT MAGNET STRUCTURES WITH SHEET MATERIAL

GOVERNMENT INTEREST

The invention described herein may be manufactured, used and licensed by or for the United States Government for governmental purposes without the payment to me of any royalties thereon.

FIELD OF THE INVENTION

The present invention relates to the manufacture of permanent permanent magnet structures, and more particularly to the manufacture of rings, cylinders, hemispheres, spheres, and other desired shapes.

BACKGROUND OF THE INVENTION

There are many devices that require a relatively strong, uniform magnetic field. For example, magnetic resonant imaging devices, power tubes for radars, and other known devices that utilize a relatively strong, uniform magnetic field. Many of these permanent permanent magnet structures provide a relatively high uniform magnetic field and have embodied the principles of a "magic" ring, cylinder, hemisphere, or sphere. For example, several permanent magnet structures of this type are disclosed in U.S. Pat. No. 5,216,401 issuing Jun. 1, 1993 to Leupold and entitled "Magnetic Field Sources Having Non-Distorting Access Ports", which is herein incorporated by reference. Therein disclosed is a permanent magnet structure having a shell of magnetic material and a hollow cavity. The shell is permanently magnetized to produce a substantially uniform magnetic field in the cavity. The magnetization of the shell is the result of two magnetization components. Another example is U.S. Pat. No. 4,835,506 issuing May 30, 1989 to Leupold and entitled "Hollow Substantially Hemispherical Permanent Magnet High Field Flex Source", which is herein incorporated by reference. Therein disclosed is a hollow hemispherical flex source which produces a uniform high magnetic field in its central cavity. The hemispherical permanent magnet structure is comprised of a plurality of wedge shaped portions having multiple sections with each section having a defined magnetic orientation.

Additionally, there have been manufacturing methods developed in an attempt to manufacture more easily these relatively complex permanent magnet structures. A method of manufacturing a magic ring or a cylinder is disclosed in U.S. Statutory Invention Registration H591 published Mar. 7, 1989, issuing to Leupold and entitled "Method of Manufacturing of a Magic Ring", which is herein incorporated by reference. Therein disclosed is a method of making a permanent magnet cylindrical structure made from magnetically hard material which provides a relatively intense uniform magnetic field within a central working space. The cylinder is cut into sections and then opposing pairs of sections are interchanged to form the desired magnetic orientation. Another method of making permanent magnet cylindrical and spherical structures is disclosed in U.S. Pat. No. 5,337,472 issued Aug. 16, 1994 to Leupold and McLane and entitled "Method of Making Cylindrical and Spherical Permanent Magnet Structures", which is herein incorporated by reference. Therein disclosed are methods of manufacturing rings, cylinders, hemispheres, and spheres having a relatively strong central magnetic field. A method is disclosed of making a hemispherical or spherical permanent magnet structure by cutting wedge or melon shaped portions into sections, rotating the sections about a radial axis prior to magnetization, magnetizing the sections in a uniform magnetic field, rotating the magnetic sections into their original positions, thereby forming the resultant desired permanent magnet structure. Additionally disclosed is the method of rearranging sections in order to obtain a desired magnetic orientation.

While many of these permanent magnet structures are desirable, they are often difficult to manufacture. Additionally, while the above described methods facilitate the manufacturing of these relatively complicated permanent magnet structures, the above methods do not lend themselves to mass production. Therefore, as these relatively complex permanent magnet structures become more widely used and incorporated into more devises, there is a need for developing manufacturing methods that are suitable for mass production, including permitting relatively easy and inexpensive manufacture of these relatively complex permanent magnet structures.

SUMMARY OF THE INVENTION

The present invention relates to a method of manufacturing permanent permanent magnet structures having substantially uniform magnetic fields from a sheet of magnetic material. In one embodiment, toroids or donut shapes are stamped from a sheet of magnetic material. The toroids are cut into sections. The sections are arranged into a predetermined magnetic orientation forming a "magic" ring that has a desired relatively uniform transverse magnetic field. The "magic" rings may be stacked to form a "magic" cylinder. In another embodiment, the "magic" rings formed from the sheet material are beveled to form wedges or slices for forming spheres, hemispheres, or other spheroidal shapes.

In another embodiment of the present invention, sheets of magnetic material are cut into trapezoids. The use of different widths of sheet material for forming trapezoids having different longitudinal lengths are used to make oblate or prolate permanent magnet structures permitting relatively distortion-free polar or equatorial access, respectively.

Accordingly, it is an object of the present invention to provide a method for mass producing permanent magnet structures having desirable relatively strong uniform working magnetic fields.

It is another object of the present invention to provide efficient manufacturing of permanent magnet structures having relatively complex shapes.

It is an advantage of the present invention that waste is reduced in the manufacture of desired permanent magnet structures.

It is another advantage of the present invention that relatively few manufacturing steps are needed to make a desired permanent magnet structure.

It is a feature of the present invention that relatively inexpensive, easily fabricated sheet permanent magnet material is used.

It is another feature of the present invention that the sheet magnetic material is easily cut and assembled to form the desired, relatively complex permanent magnet structure.

These and other objects, advantages, and features will become readily apparent in view of the following detailed description.

DETAILED DESCRIPTION OF THE PREFERRED EMBODIMENT

Figure 1A:
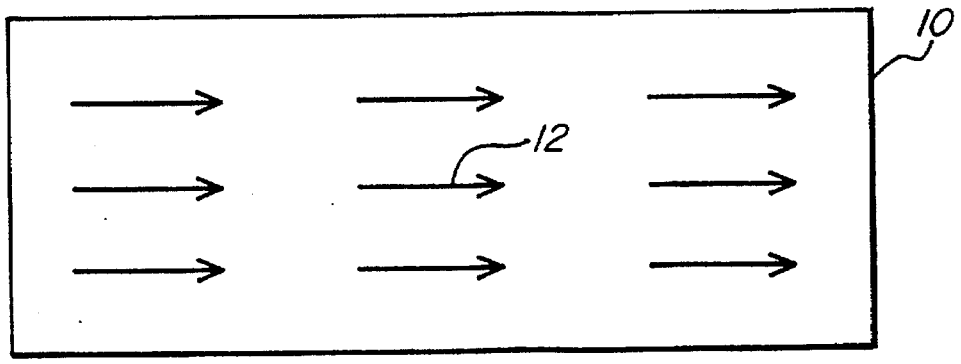
FIG. 1A is a pictorial view of a sheet of permanent magnet material.
Figure 1B:
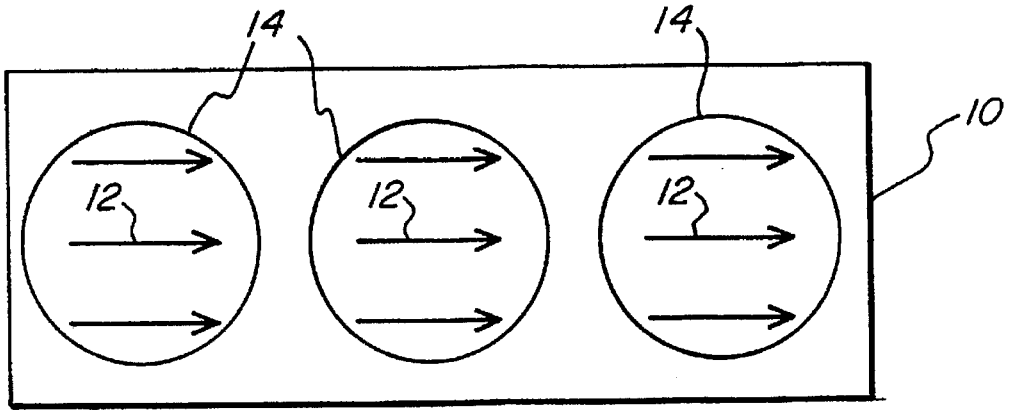
FIG. 1B is a pictorial view of the sheet permanent magnet material having circles cut therein.
Figure 1C:
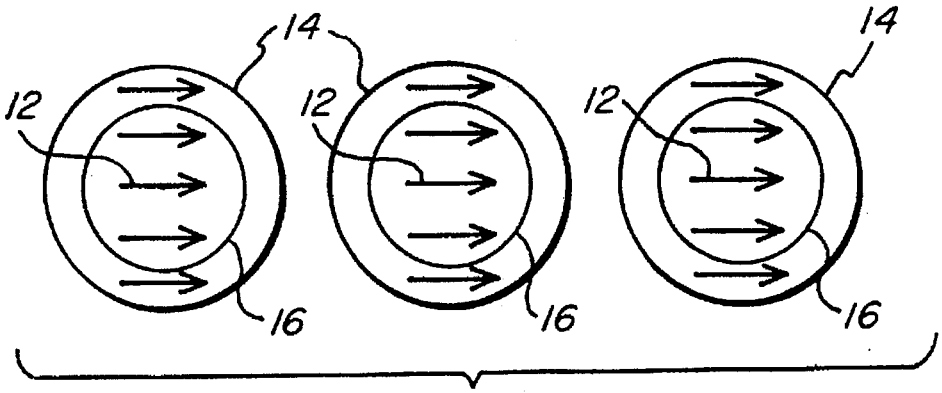
FIG. 1C is a pictorial view illustrating the formation of a plurality of toroidal shapes.
Figure 1D:
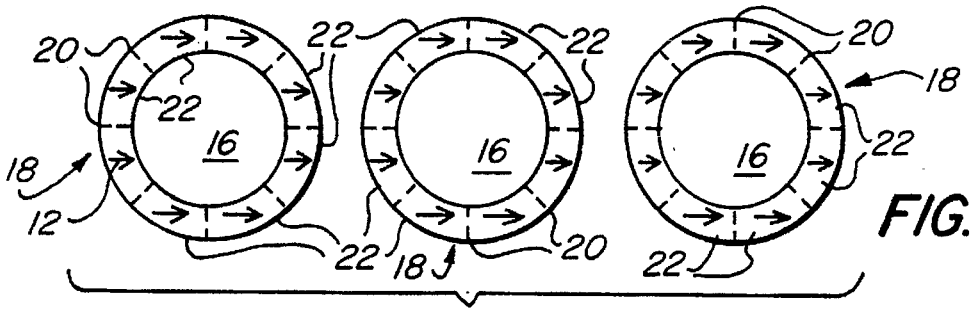
FIG. 1D is a pictorial view illustrating the cutting into sections of the plurality of toroidal shapes.
Figure 1E:
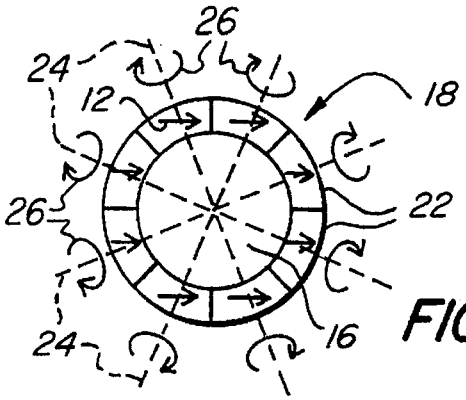
FIG. 1E is a pictorial view illustrating the repositioning of the sections of one of the plurality of toroidal shapes.
Figure 1F:
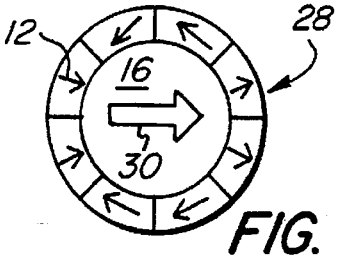
FIG. 1F is a pictorial view illustrating a "magic" ring formed by the repositioning of the sections in one of the plurality of toroidal shapes.
Figure 1G:
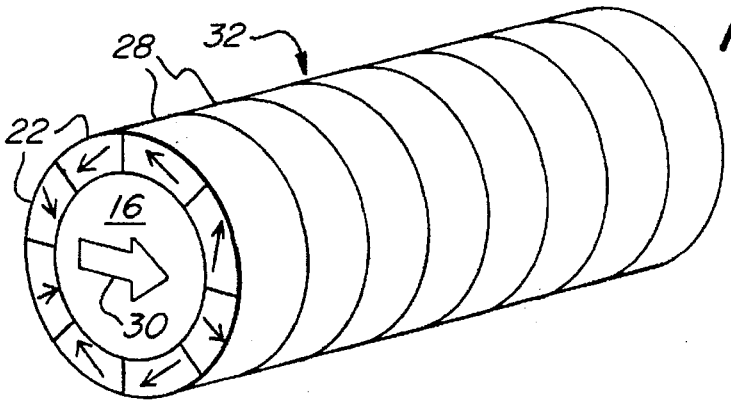
FIG. 1G is a perspective view illustrating a plurality of "magic" rings stacked to form a "magic" cylinder.

FIG. 1A illustrates a sheet of permanent magnet material 10. The sheet of permanent magnet material 10 is substantially planar and has a magnetization parallel to the surface and in a longitudinal direction. The orientation of the magnetization is illustrated by arrows 12. The sheet of permanent magnet material 10 is uniformly magnetized. The sheet of permanent magnet material 10 is made of any well known current permanent magnet material. The manufacture of sheets of permanent magnet material 10 are well known and accomplished relatively easily and inexpensively. From the sheet of permanent magnet material 10 are cut discs 14. The cutting of discs 14 from the sheet of permanent magnet material 10 may easily and inexpensively be accomplished by a grinding cutter. FIG. 1C illustrates the cutting of holes 16 from the plurality of discs 14. Similarly, the cutting of holes can easily and inexpensively be accomplished by stamping. FIG. 1D illustrates the plurality of the toroidal or donut shapes that are easily and inexpensively stamped out of the sheet of permanent magnet material 10. The toroidal or donut shaped permanent magnet material 18 is cut along radial lines 20 to form sections 22. The number of sections 22 cut from each of the plurality of toroidal shapes 18 depends upon the application. However, in general, the larger the number of sections the more uniform the resultant working magnetic field will be. By rotating each section 22 along its radial axis 24 one-half a revolution or 180°, as illustrated in FIG. 1E by arrows 26, the desired magnetic orientation for a "magic" ring 28 is obtained as illustrated in FIG. 1F. As illustrated in FIG. 1F, the working magnetic field within bore 16 is relatively strong and in the direction of large arrow 30. Other methods of repositioning the sections 22 may be used, such as those disclosed in U.S. Pat. No. 5,337,472 and U.S. Statutory Invention Registration H591 referred to above. FIG. 1G illustrates the formation of a "magic" cylinder 32. The "magic" cylinder 32 is formed by stacking a plurality of the "magic" rings 28. In view of the large number of "magic" rings 28, that are required to form a "magic" cylinder 32, the benefits of using techniques to mass produce permanent magnet structures can readily be appreciated.

Figure 1J:
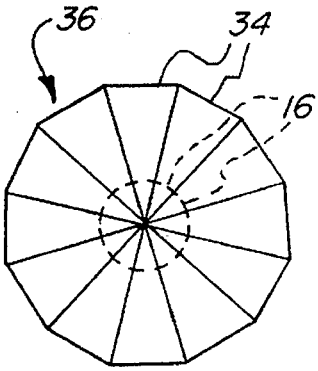
FIG. 1J is a top plan view illustrating the assembly of a plurality of spheroidal segments, wedges, or slices substantially forming a sphere.
Figure 1H:
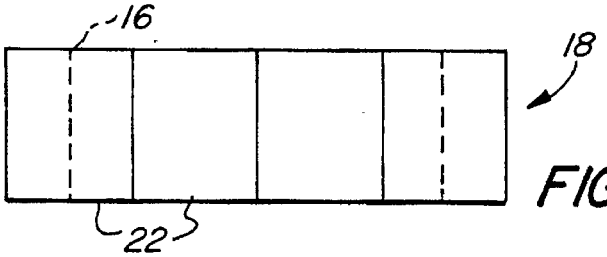
FIG. 1H is a top plan view illustrating a "magic" ring.
Figure 1I:
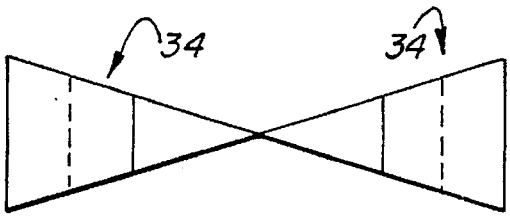
FIG. 1I is a top plan view illustrating the two spheroidal segments, wedges, or slices formed from the "magic" ring.

FIGS. 1H, 1I, and 1J illustrate the application of the present invention to the formation of a spheroidal or spherical shape such as a hemisphere or a sphere. The toroidal or donut shaped permanent magnet material 18 is divided in the direction of the magnetic field along the axial diameter. The two halves are beveled forming spheroidal portions, slices, or wedge-like, trapezoidal or spherical segments 34. The axial diameter of division formed at the apex of the spherical segments 34. The resulting spherical segments 34 rearrange to obtain the desired magnetic orientation and azimuthally assembled about the axial diameter to form the desired spheroidal or substantially spherical permanent magnet structure 36 illustrated in FIG. 1J, thereby creating a "magic" sphere having a desired substantially uniform working magnetic field formed in the cavity created by bore sections 16.

Figure 2A:
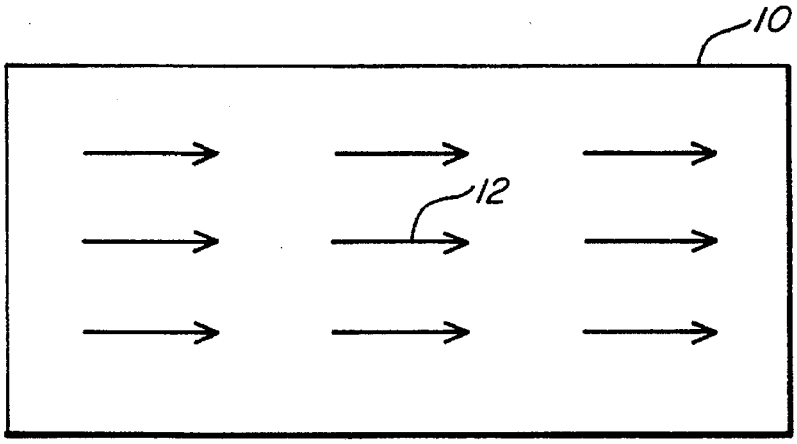
FIG. 2A is a pictorial view illustrating a sheet of permanent magnet material.
Figure 2B:
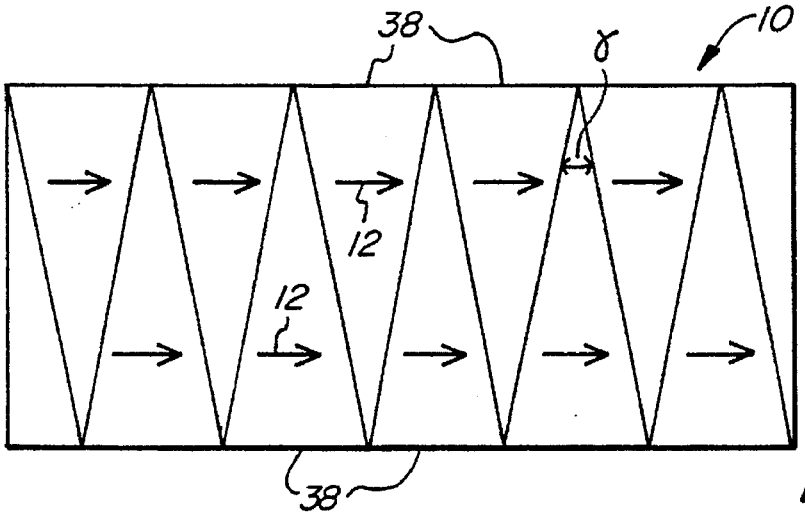
FIG. 2B is a pictorial view illustrating the cutting of the sheet of permanent magnet material.
Figure 2C:
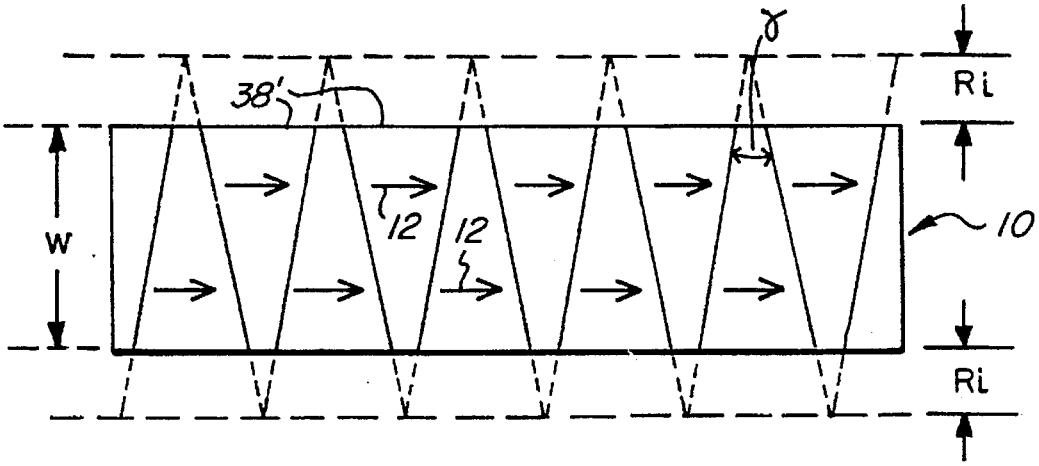
FIG. 2C is a pictorial view illustrating the formation of the plurality of trapezoids.
Figure 2D:
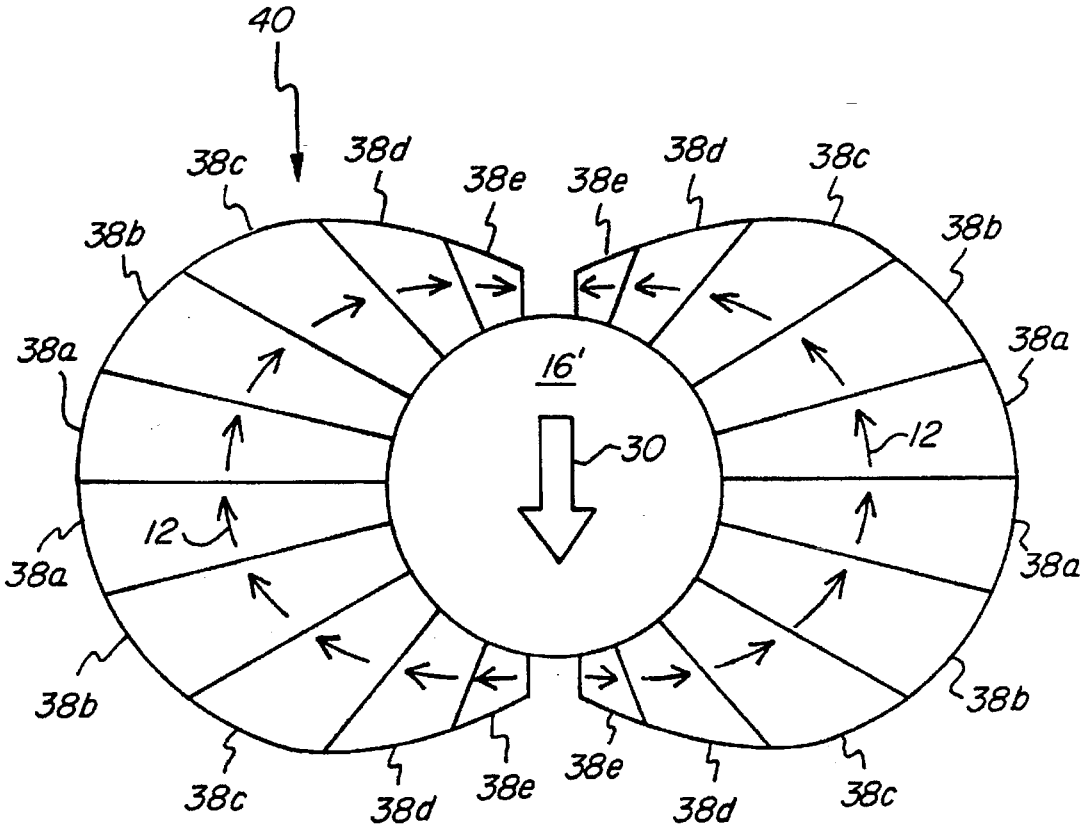
FIG. 2D a pictorial view illustrating the formation of an oblate permanent magnet structure.

FIGS. 2A, 2B, 2C, and 2D illustrate the use of a sheet permanent magnet material 10 in forming a desirable oblate permanent magnet structure. By oblate permanent magnet structure it is meant that the radial dimension varies, permitting relatively distortion-free polar access with the use of a uniformly magnetized permanent magnet material. FIG. 2A illustrates a sheet of permanent magnet material 10 having a uniform magnetization represented by arrows 12. The sheet of permanent magnet material 10 is cut into triangular shaped sections 38. The smallest angle of each triangular shaped section 38 forms a vortex. The direction of magnetization represented by arrows 12 of each triangular shaped section 38 is transverse and preferably perpendicular to the longitudinal axis of the triangular shaped sections 38. FIG. 2C illustrates the formation of a plurality of trapezoids 38' by the cutting of a distance $R_i$ in from each longitudinal edge of the sheet of permanent magnet material 10. The resulting trapezoids 38' have a longitudinal length W. The length cut from each longitudinal end of the sheet of permanent magnet material 10 has a length $R_i$ equal to the radius of the desired working space having the working magnetic field of the resultant permanent magnet structure to be formed. Alternatively, the trapezoidal shapes may be directly cut from the sheet of permanent magnet material 10. FIG. 2D illustrates the formation of an oblate permanent magnet structure using the trapezoidal shaped sections cut from the sheet of permanent magnet material 10. A different longitudinal length is used for each of the trapezoidal sections **38*a*–38*e*. One each of the trapezoidal sections 38*a*–*e* is used for each quadrant. For the oblate permanent magnet structure 40 illustrated in FIG. 2D, five different widths W of sheet permanent magnet material 10 are needed. The longitudinal length of each trapezoidal section 38*a*–38*e* varies, with the longest longitudinal length located at the equator and the shortest longitudinal length located near a pole. The resulting working magnetic field within the and working space or cavity formed by bore 16' is illustrated by arrow 30. Because the magnetic orientation, represented by arrows 12, is perpendicular to the longitudinal or radial axis of each of the trapezoidal sections 38*a*–38*e*, the resulting magnetic orientations are substantially tangential to the edge of the working space or cavity formed by bore 16'. The number of toroidal sections 38' needed to assemble the oblate permanent magnet structure 40** is given by the following formula:

$$n=\frac{360}{\gamma}$$

where gamma is the angle, in degrees, subtended by each trapezoidal section or the angle formed by the vortex. The angle gamma of the vortex is selected depending upon the position and fineness of texture of the desired magnetic field. However, the approximation is very good even for relatively large angles of gamma. In extreme cases, a small angle gamma may be used resulting in a large number of trapezoidal sections, and the surfaces may be ground to more closely conform to an ideal or theoretical exterior surface curve of the desired oblate permanent magnet structure. Additionally, the oblate permanent magnet structure 40 illustrated in FIG. 2D may be in the form of a single ring, a plurality of rings forming a cylinder, or an assembly of rings that have been beveled and assembled into a spheroid. The shape of the stamped sections of permanent magnet 10 are illustrated as being trapezoidal, however other predetermined shapes may be stamped. For example, other quadrilateral shapes may be used, or a predetermined shape that will form the preferred exterior curved surfaces may be directly cut. This will eliminate the need for cutting or grinding smooth, if desired, the stepped exterior surfaces that will result when trapezoidal sections are combined.

Figure 3A:
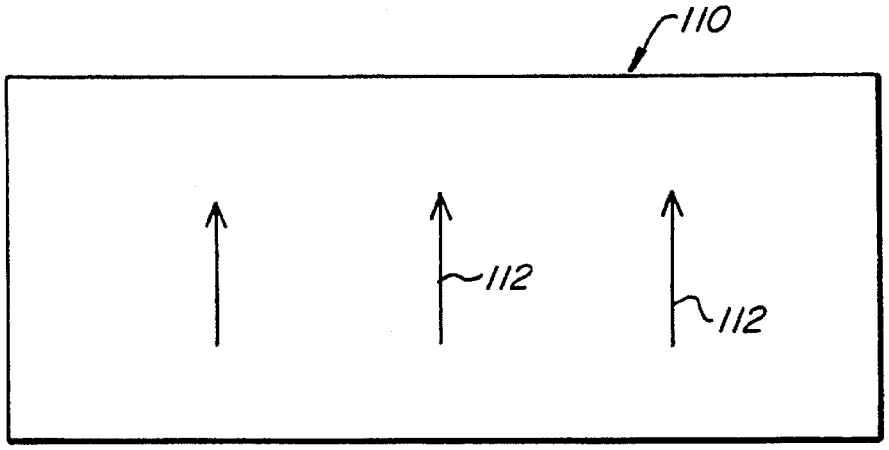
FIG. 3A is a pictorial view illustrating a sheet of permanent magnet material.
Figure 3B:
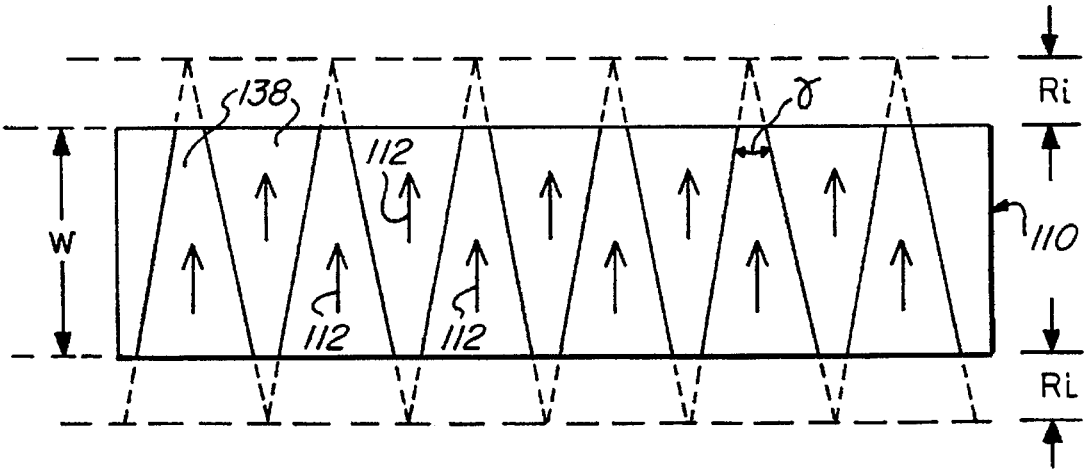
FIG. 3B is a pictorial view illustrating the cutting of the sheet of permanent magnet material into trapezoids.
Figure 3C:
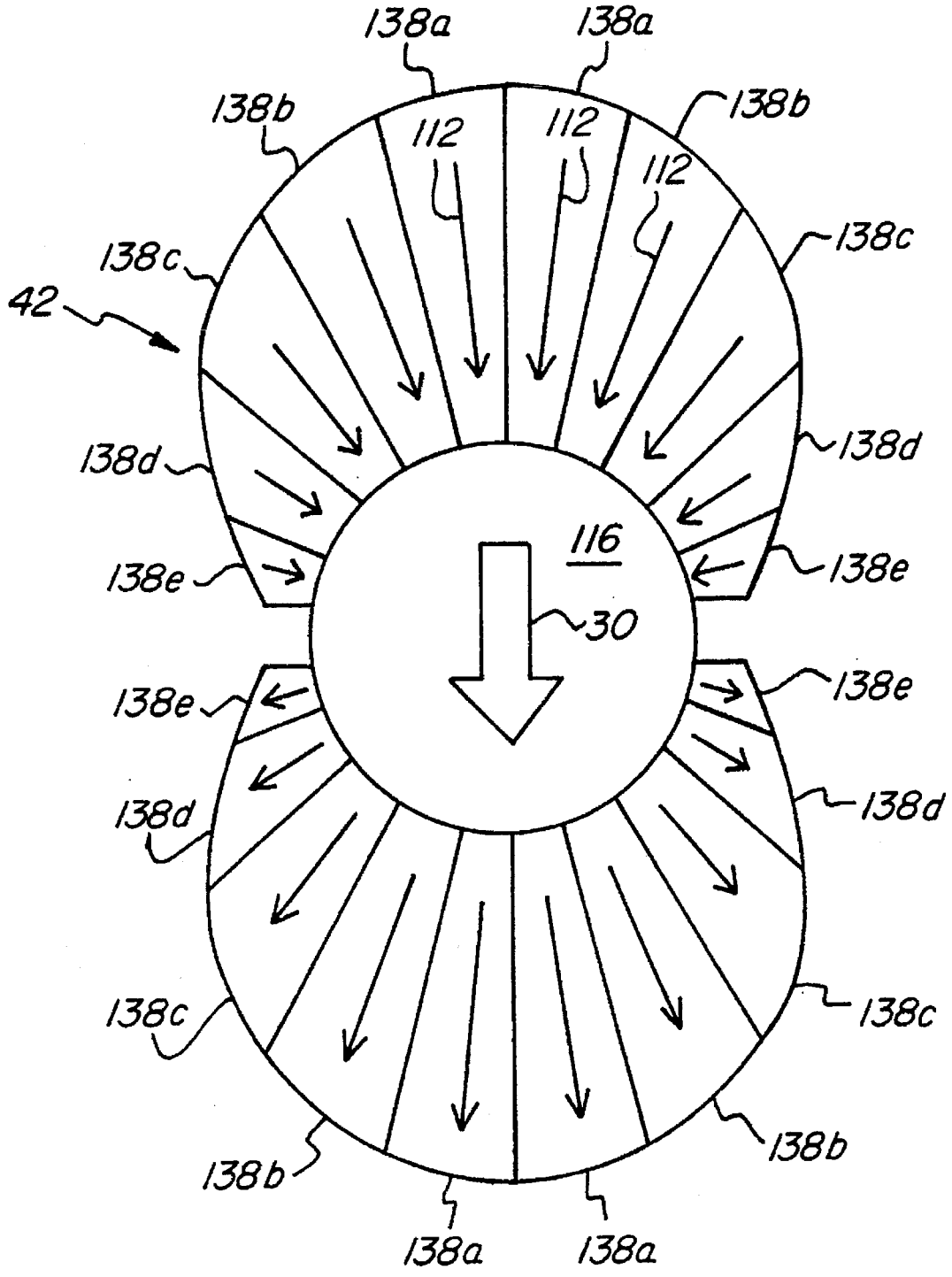
FIG. 3C is a pictorial view illustrating the formation of a prolate permanent magnet structure.

FIGS. 3A, 3B, and 3C illustrate the analogous method of manufacturing a prolate permanent magnet structure. By prolate permanent magnet structure, it is meant that the radial dimension is elongated at the poles permitting relatively distortion-free equatorial access with the use of a uniformly magnetized permanent magnet material. FIG. 3A illustrates a sheet of permanent magnet material 110 that has a magnetic orientation illustrated by arrows 112. The magnetic orientation is substantially perpendicular to the longitudinal axis of the sheet of permanent magnet material 110. The sheet of permanent magnet material 110 is cut into a plurality of trapezoidal sections 138. The trapezoidal sections 138 have a longitudinal length W. The vertex formed by the two longitudinal sides of the trapezoidal sections 138 form an angle gamma. Accordingly, the magnetic orientation, represented by arrows 112, is parallel to the longitudinal axis of the trapezoidal sections 138. As discussed above, the trapezoidal sections 138 may be formed by the cutting of a triangular section or by directly cutting the trapezoidal sections 138 from the sheet of permanent magnet material 110. Additionally, as discussed above, the angle gamma is selected depending upon the desired properties of the magnetic field, with the smaller of the angle gamma corresponding to more closely achieving the ideal or theoretical magnetic field. However, illustrated in FIG. 3C, the prolate permanent magnet structure 42, for purposes of example, illustrates five trapezoidal sections **138*a*–138*e* each having different a different longitudinal or radial lengths. One each of the five trapezoidal sections 138*a*–138*e* is used per quadrant. Therefore, for a predetermined width of the sheet of permanent magnet material 110, four trapezoidal sections will be used, one for each quadrant. The assembled prolate permanent magnet structure 42 results in a working cavity or space formed by bore 116 having a substantially uniform magnetic field in the direction indicated by arrow 30. As indicated above, in order to achieve a more uniform or ideal magnetic field, the exterior surfaces of the trapezoidal sections 138*a*–138*e* may be ground to more closely approximate the desired ideal or theoretical curved surface. Additionally, as indicated above the other quadrilateral shapes may be used, or a predetermined shape that will form the preferred exterior curved surfaces may be directly stamped. The magnetic orientations, represented by arrows 112, of the trapezoidal sections 138*a*–138*e* are substantially perpendicular to the surface of the working space or cavity formed by bore 116. Additionally, as indicated above, the prolate permanent magnet structure 42** may be made in the form of a ring, cylinder, or spheroid using the methods as described above.

The present invention, in utilizing relatively inexpensive, easily produced or manufactured inexpensive sheets of permanent magnet material, provides a method of manufacturing relatively complex permanent magnet structures that is readily susceptible to mass production. Therefore, the present invention reduces the cost and time required to manufacture known, relatively complex permanent magnet structures, permitting these permanent magnet structures to be widely used and made available for numerous known applications that previously could not be made available due to cost. Therefore, it should be appreciated that the present invention greatly advances the art relating to the manufacture of permanent magnet structures. Additionally, while several embodiments have been illustrated and described, it will be obvious to those skilled in the art that various modifications may be made without departing from the spirit and scope of this invention.

What is claimed is:

1. A method of making an oblate permanent magnet structure having a desired working magnetic field in a working space comprising the steps of:

magnetizing a plurality of sheets of permanent magnet material in a predetermined direction;

cutting the plurality of sheets of permanent magnet material having a magnetic orientation into a plurality of predetermined shapes such that the magnetic orientation is transverse to the longitudinal axis of each of said plurality of predetermined shapes, each of said plurality of sheets having a different width; and assembling said plurality of predetermined shapes into an oblate permanent magnet structure such that the magnetic orientation of each of said plurality of predetermined shapes is substantially tangential to the working space containing the desired working magnetic field.

2. A method of making a permanent magnet structure as in claim 1 wherein:

said plurality of predetermined shapes are trapezoidal.

3. A method of making a prolate permanent magnet structure having a desired working magnetic field in a working space comprising the steps of;

magnetizing a plurality of sheets of permanent magnet material in a predetermined direction;

cutting the plurality of sheets of permanent magnet material having a magnetic orientation into a plurality of predetermined shapes such that the magnetic orientation is substantially parallel to the longitudinal axis of each of said plurality of predetermined shapes, each of said plurality of sheets having a different width; and assembling said plurality of predetermined shapes into a prolate permanent magnet structure such that the magnetic orientation of each of said plurality of predetermined shapes extends substantially radially from a central point in the desired working space containing the working magnetic field.

4. A method of making a permanent magnet structure as in claim 3 wherein:

said plurality of predetermined shapes are trapezoidal.

* * * * *